US005705213A

United States Patent [19]

Guillin

[11] Patent Number: 5,705,213

[45] Date of Patent: Jan. 6, 1998

[54] PACKAGE FOR THE PACKAGING AND THE PRESERVATION OF FRESH FOOD

[75] Inventor: François Guillin, Mouthier Haute Pierre, France

[73] Assignee: Groupe Guillin (S.A.), Ornans, France

[21] Appl. No.: 630,756

[22] Filed: Apr. 10, 1996

[30] Foreign Application Priority Data

Apr. 19, 1995 [EP] European Pat. Off. ..... 95440016

[51] Int. Cl.[6] ..... B65D 1/34; B65D 85/00

[52] U.S. Cl. ..... 426/129

[58] Field of Search ..... 426/129; 206/524.1, 206/557

[56] References Cited

U.S. PATENT DOCUMENTS 3,563,445 2/1971 Clayton ..... 426/129 X
5,591,496 1/1997 Anderson et al. ..... 428/36.5

FOREIGN PATENT DOCUMENTS 631520 11/1992 Australia .
WO86/7036 12/1986 WIPO .
WO92/8610 5/1992 WIPO .

*Primary Examiner*—Leo B. Tentoni

*Attorney, Agent, or Firm*—Abelman, Frayne & Schwab

[57] ABSTRACT

A package is disclosed for the packaging and the preservation of fresh food, such as meat, sea products and the like, which tends to exude fluids favoring a rapid growth of bacterial flora which limits the selling deadline. The package is of the type which includes a tray upon which the fresh food product is placed, and a thermoretractable thin sheet of film material for overlapping the food product contained in the tray. The tray includes a relatively rigid and impermeable first container portion and a second container portion upon which the fresh food product rests. The second container portion is fitted in the first container portion, and includes apertures which allows for the passage of the fluid which may be exuded by the fresh food product. The second container portion rests on corrugations or ribs of the first container portion to define a desired number of closed chambers, characterized that in order to allow an isostatic rigidification of the first container portion, and a controlled collecting of the fluids exuded by the fresh food product into the chambers, the ribs are distributed according to at least one network of approximately parallel ribs. Each of the ribs extends at least along two directions so that each of the points of the rib is directed to resist a corresponding component of the peripheral stresses caused by the film material which overwraps the package.

18 Claims, 5 Drawing Sheets

PACKAGE FOR THE PACKAGING AND THE PRESERVATION OF FRESH FOOD

FIELD OF THE INVENTION

The invention relates to a new product for packing and preserving fresh food, particularly intended to pack meat or sea products, tending to exude liquids contributing to the spreading of bacterial flora inside the thin sheet of transparent plastics material closing and insulating the product and the package from outside.

BACKGROUND OF THE INVENTION

In the past, such packing products have been made by taking a support tray fabricated from thermoplastic materials as polystyrene, on which the product is presented, both being then closed by a thin sheet of transparent material as polyethylene.

The coming out of such packing products coincides with the emergence of supermarkets provided with self service department of fresh products.

The present tendancy, based on the increasing rise of big distribution channels, is to step up the number of products sold by this way. The advantage for consumers is to avoid to queue up in front of the market stalls, especially at the rush hours.

At least two problems have been noted in connection with packaging poducts in this fashion.

Firstly, it is well-known that fresh products, when they are displayed in such packaging, especially when the products are meat and sea products, like butchery, delicatessen or fish shop products, are considered as less fresh as if they had been sold in the stalls. Consumers sometimes do not trust the selling deadline written on the packages.

This reputation is at least in part due to the aspect of the fresh products, as seen through the thin transparent filmy sheet: at the sight of the blood exuding from a piece of meat put on the support tray, or more generally if the product lies in the exuded liquid, the consumer is not really tempted to buy it. This is even greater for a fish lying in its exudate, making it not really appetizing.

Several solutions have already been suggested to overcome this disadvantage.

As disclosed by POT WO 86/07036, the package comprises a first container portion on which the moisture-containing product is put, for instance meat, and a second container portion, coupled together to define a space therebetween for receiving liquid which can seep from the content of the package. The outermost portion is provided with corrugations and is adhered to the first portion by welding. Apertures are provided in the innermost container to communicate the interior of the package with the aforementioned space, so that the blood passes from the inside of the package to this space. Meat packaged in such packages has therefore an attractive appearance, and the aforementioned problem is solved.

The parallel spaced corrugations define between themselves parallel internal chambers, in which the liquid which gathers in the chambers will not return to the interior of the package, even if said package is rocked around an axis parallel to the corrugations. The liquid can however accumulate in one or the other of the two other perpendicularly oreinted sides of the outermost portion, when the latter is rocked around an axis perpendicular to the corrugations.

As a result, if it is true that the liquid is taken away from the sight of consumers, it continues however to exist, as well as the risks and deficiencies involved by its existence.

As another solution, material having an absorptive nature has been used to be in contact with the product. The problem in this case is that on one hand the appearance of the tray remains unappetizing and unpleasant, and on the other hand the liquid absorption into the support tray has a weakening effect on the tray structure. Furthermore, the moisturization of the support tray could result in decreasing the preservation ability of the packaging.

Attemps have been made to remedy these deficiencies by using a support tray comprising three different layers, the one in contact with the fresh product having a non absorptive nature, while the outermost layer is impervious to any liquids. The intermediate layer is however made of an absortive material, communicating with the interior of the package by mean of small holes.

This is for instance disclosed by PCT WO 92/08610, consisting in making a package with three sheets, each having its own features:

The innermost sheet, intended to be in contact with the product, is perforated by two regularly spaced holes rows, The intermediate sheet, absorbing liquids, and The outermost sheet, in the same material as the innermost sheet, and overwrapped with a transparent material as polyethylene film material or cellophane.

Such a packaging is however still not entirely satisfactory, the most undesirable deficiency being that the intermediate sheet does not have any space to become inflated in case of sudden and important incoming of liquid passing through the holes.

The three sheets are moreover glued to each other, preventing air from circulating therebetween, and especially between the outermost and the innermost sheets. A ventilation would however allow the air to be regenerated, as it is polluted by the bacterial flora, appearing after some hours in the moisturised intermediate sheet. As a result, the permanent exchange between the product and the intermediate sheet is made by the air, which get gradually worse.

As last, the absorbing layer causes the wet area to be spread over the widest possible surface, in connection with the amount of liquid which has passed through the apertures and with the absorptive power of the intermediate sheet. The latter tends consequently to spread the cause of the problem met in such packages.

The aforementioned first problem is as discussed not solved correctly.

A second problem is in connection with the utilized packaging technique, and of more mechanical nature.

In most cases, the thin transparent sheet is a thermoretractable sheet, having the ability to shrink during a heating operation, and to stick close to the periphery of the volume of the closed product. This is widely used for packing a lot of products, because this technique allows the products to be firmly secured on the support, and also to remove the most part of the air included in the thin sheet before heating, withdrawing the products from oxigen action.

The shrinking however submits the overwrapped product, as well as the support tray, to a strong peripheral stress, tending to twist said support tray especially by buckling it along its great length. This tendancy is increased by the fact that the support tray is made in a sheet which is as thin as possible in order to keep the weight low, and also for economic reasons.

Instead of this technique, a welding of the thin transparent sheet over the periphery of the support tray could also be used, but the aforementioned deficiency can also be noted.

Even without this peripheral stress, the weight of the product can cause the distortion of the support tray, especially when it is big sized, for instance for a big flat fish.

The solutions presented by prior art documents consist generally in rigidifying the support tray by mean of molded corrugations.

Australian Patent No. 631 520 thus discloses a meat packaging having two container portions with strengthening corrugations. In case of shocks, the corrugations help to protect small bags containing absorbing material located between the two portions, preventing them from being broken.

The corrugations of the two portions are moreover perpendicular to each other, but the two sets of corrugations are in fact superimposed and only intended to rigidify and strength separatly the two portions of the tray, each one in an unique direction.

SUMMARY OF THE INVENTION

The present invention relates to a new device providing means for simultaneously and conjointly solving the both aforementioned problems, i.e. removal of the consequences of the product's exudates, and construction of an indeformable package notwithstanding any stress especially due to the thin transparent sheet closing the product in the tray.

For this purpose, the package according to the present invention, being of the type comprising a support tray closed by a thin plastic thermorestraining transparent sheet, is composed of:

a quite rigid impermeable first container portion, and a second container portion fitted into the first one, on which rests the product, including apertures allowing the passage of the liquid, an intermediate layer possible resting or being welded on corrugations or ribs of the first container portion, thus defining a certain number of closed chambers. The invention consists in the fact that, in order to allow an isostatic rigidification of the first container portion, and a controlled collecting of the liquids exsuded by the products in the chambers, the ribs are distributed according to at least one network of approximately parallel ribs, each rib extending along at least two directions, so that it is in each point directed to resist to the corresponding component of the peripheral stress caused by the film material overwrapping the package.

To completely carry out the function of isostatic rigidifying, said ribs are preferably distributed so that the direction of each rib is at both ends approximately perpendicular to one of the side of the first container portion, or even better that one end is perpendicular to an adjacent side, while the other end is perpendicular to an adjacent side.

Generally speaking, the ribs can take every possible geometric shape. As a possible embodiment, ribs can be polygonal. In this case, the most simple embodiment consists in two portions forming an obtuse angle.

According to another possible embodiment, only a part of the first container portion is provided with ribs, another part being raised and flat, at the level of the summits of the ribs. This part can take any proportion of the total surface of the bottom of the first container portion.

According to a preferable embodiment, the ribs are rounded, and more particularly take the general shape of arcs of ellipses distributed into four groups in the four rectangular quadrants of the bottom defined by the two axes of symmetry. Each arc of ellipse is elongated, one of the ends being located along one side, or nearly, and being approximately perpendicular to this side, the other side being along the adjacent side, and approximately perpendicular to this adjacent side. The chambers are then also elongated and curved.

As a result, the first container portion, in this particular embodiment, keep its shape under every circumstances, even when it is submitted to the action of the peripheral stresses caused by the shrinking of the film material. On the other hand, this embodiment defines chambers constituting a network with meshes in which open at least one of the foresaid apertures, so that this embodiment canalizes, cuts off and keeps the part of the liquid having passed the innermost second container portion by mean of said apertures in several individual parts, preventing them from moving in the total space defined between the first and the second container portions, and from accumulating in one area, where the said part of the liquid could contaminate the packaged product.

The aforementioned double result bring a simultaneous solution to the two mentioned problems.

The ribs can practically take various shapes, provided that in each point, from one end to the other one, each rib contributes, because of its curved shape, to the resistance against buckling in the direction corresponding to the location of the point.

Said ribs can thus be concav or convex. They can also be individual, or grouped by two or by four. In each case, the chamber defined between two adjacent ribs is elongated, having the general shape of an ellipse from one side of the first container portion to the other side, or having the shape of a curvilinear V, or of a curvilinear square or rectangle. Each chamber comprises according to the invention at least one aperture in the second container portion.

The apertures are provided with a wall portion having the shape of a sawn-off cone which extends towards the first container portion, and, according to the present invention, in order to start by capillarity the flowing of the liquid in said apertures, they are provided with biased drains opening in the upper part of the apertures, the depth of said drains increasing to reach at the location of said apertures, the length of said wale portions extending towards the first container portion.

The packaging device according to the present invention allows the draining of the liquid exuded by the packaged products, and its division into small volumes kept between the first and second container portions, without any contacts with said product. Some of the defined chambers have for geometric reasons a certain length, along which the liquid may move: the rounded shape results in a laying out and in an adhesion of said liquid to the rounded wall of the chamber, preventing it from getting accumulated in a particular area between the first and the second container portions.

In order to still reduce the volume of liquid exuded by the product and reaching the chambers, it is also possible to put an intermediate layer between the second container portion and the highest part of the ribs bearing said second container portion. This intermediate pad fills at least partially this area, for absorbing liquids as well as for improving the conservation by improving the gaseous exchanges.

Such a pad may contain products able to retain water, antibacterial products and/or hydroreagents, in order to regenerate the atmosphere, thus contributing to the preservation of the packaged fresh products.

These and other objects of the invention and various features and details thereof are hereinafter more fully set forth with reference to the accompanying drawings, wherein:

DETAILED DESCRIPTION OF THE DRAWINGS

Figure 1:
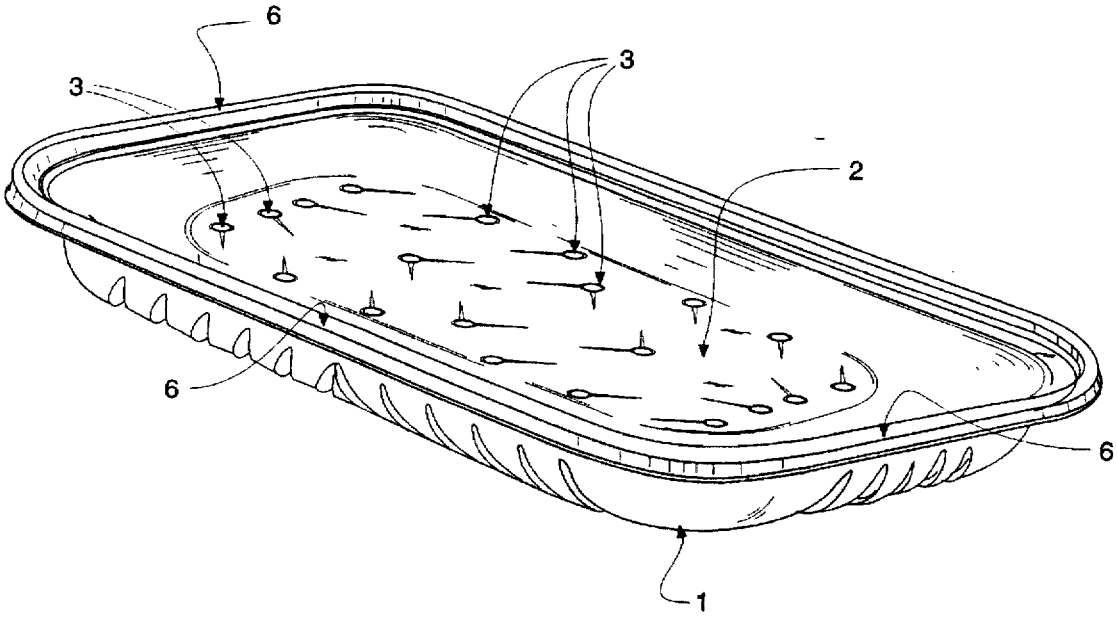
FIG. 1 is a perspective view of a preferred embodiment of the package according to the invention, represented without any products.
Figure 3:
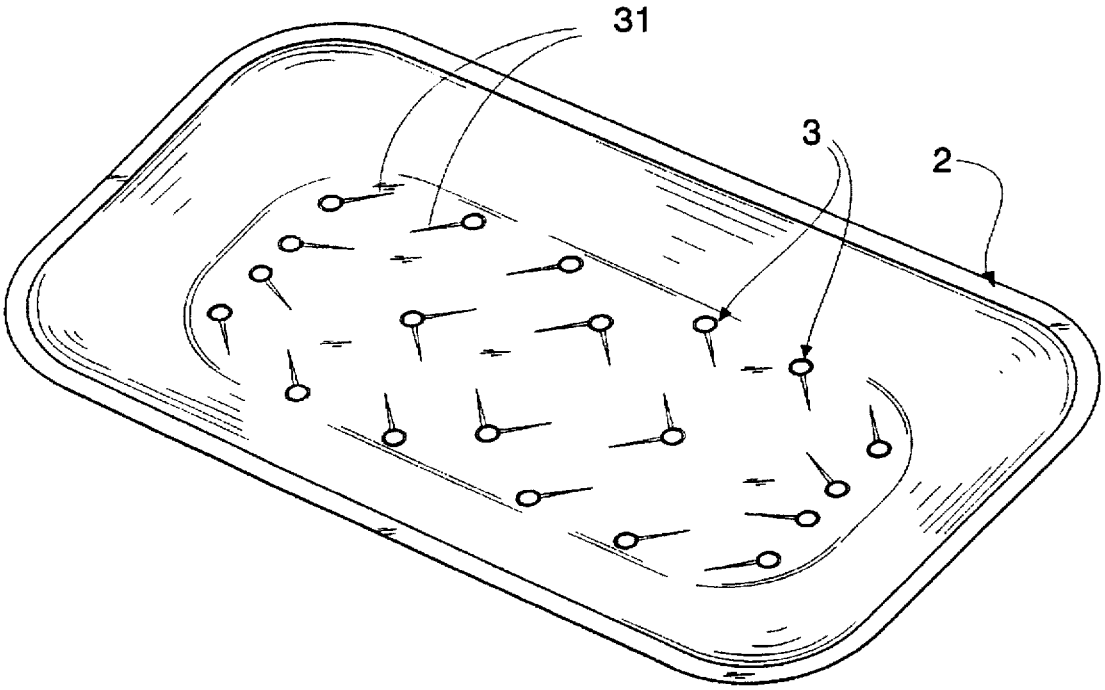
FIG. 3 is a perspective view of the second container portion.
Figure 3A:
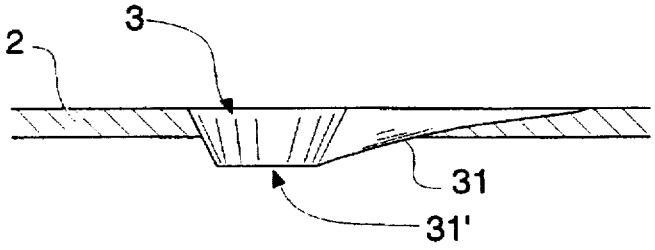
Figure 4:
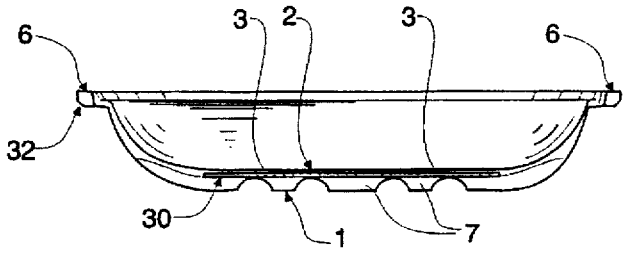
Figure 4A:
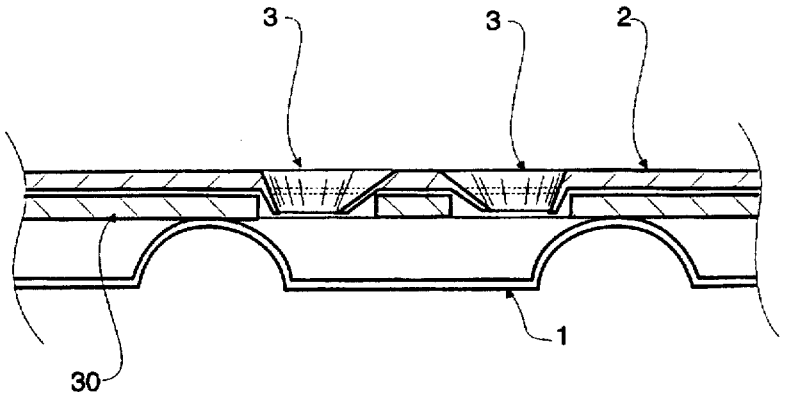
Figure 5:
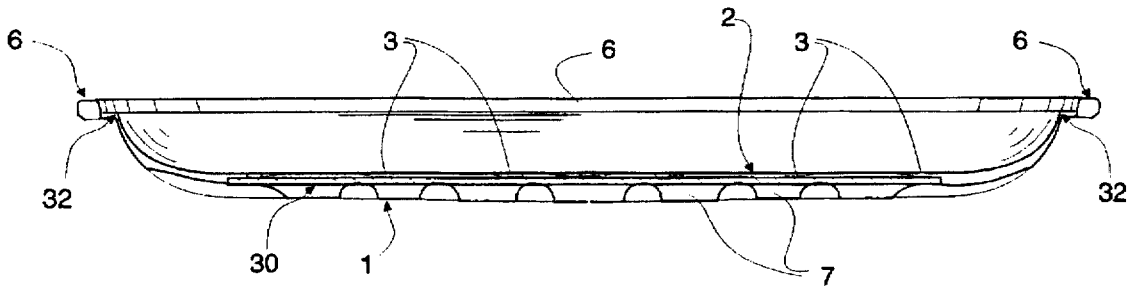
Figure 6:
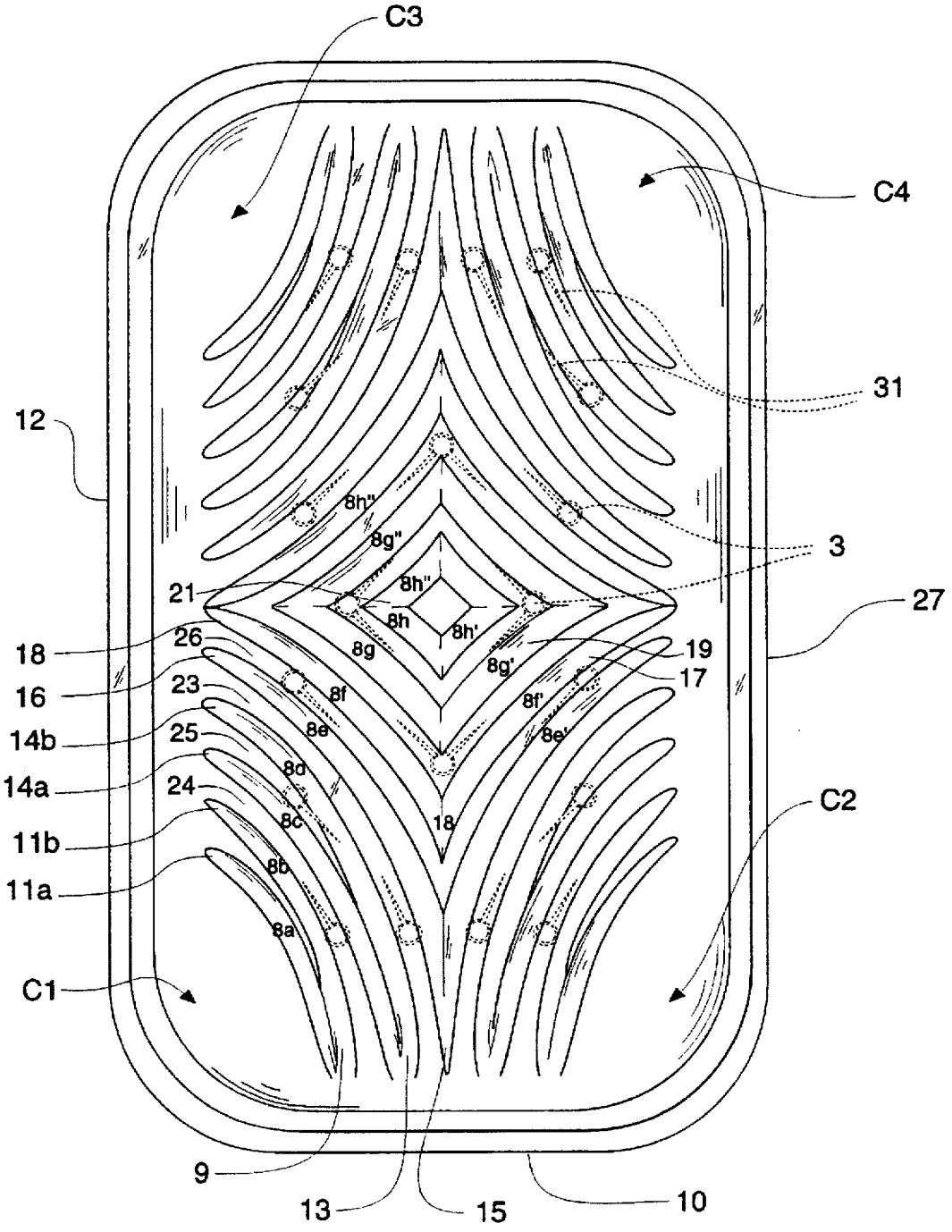
Figure 7:
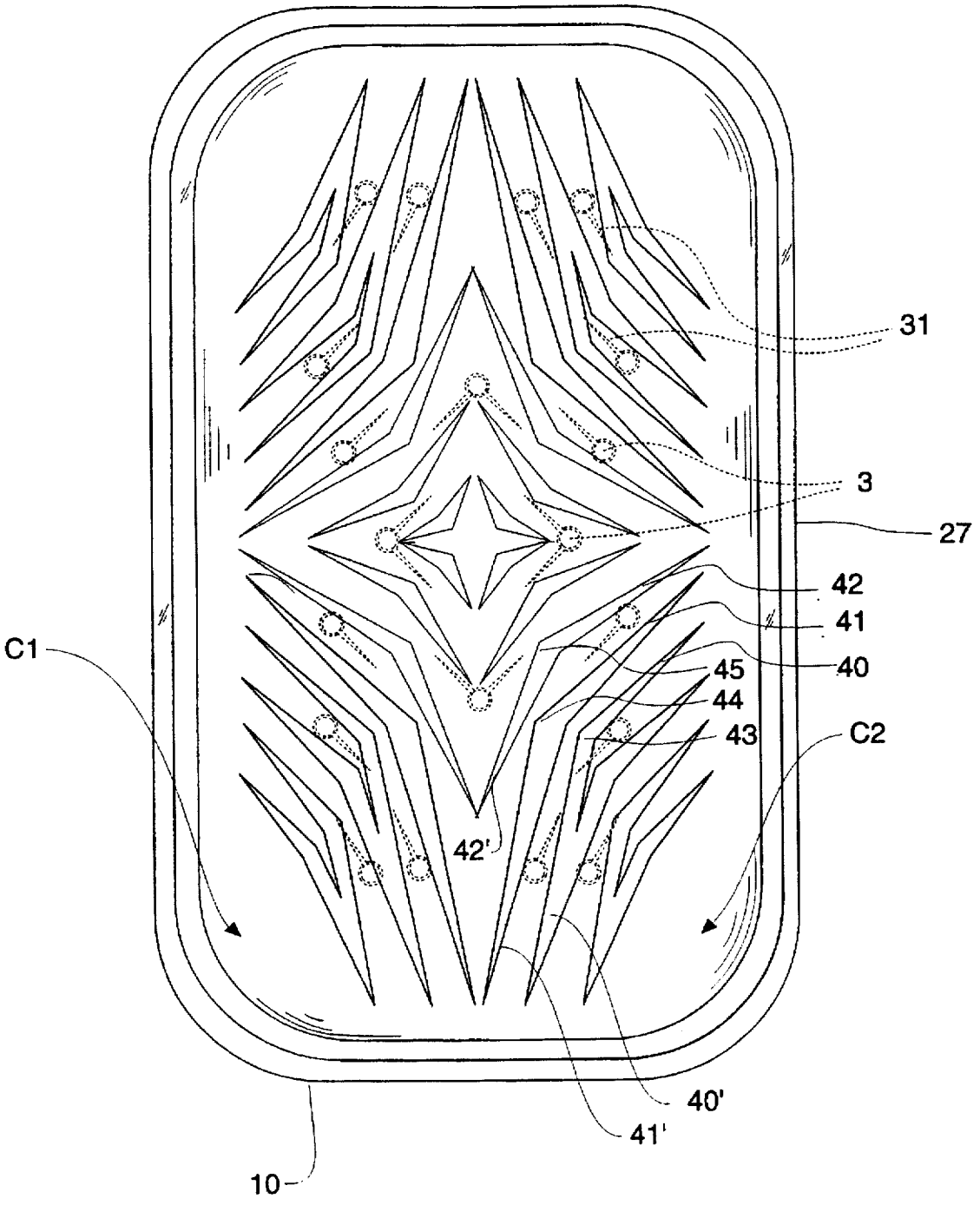

FIG. 3*a* is an enlarged sectional view of one aperture made in the second container portion;

FIG. 4 and FIG. 5 are vertical sectional views of the embodiment of FIG. 1, taken on two symmetrical plans of the package of the invention, including an intermediate absorbing pad between the second container portion and the ribs;

FIG. 4*a* is an enlarged part of FIG. 4, showing the relative positions of the second container portion with its apertures and of the absorbing pad;

FIG. 6 is a top view of the first container portion, with information about the location of the apertures of the second container portion and of the corresponding drains; and FIG. 7 is another possible embodiment of FIG. 6.

In every figures, all of the numeral references refer to the same elements of the package according to the invention.

DETAILED DESCRIPTION OF THE PREFERRED EMBODIMENTS

With reference to FIG. 1, the tray of the present invention comprises an impervious rigid first container portion 1 and a second container portion 2 including apertures 3. The first and the second container portions 1, 2 are fixed along their periphery 6, fitted in each other or welded, so that a closed space 7 is created between them, as it appears on FIG. 4 and FIG. 5.

Figure 2:
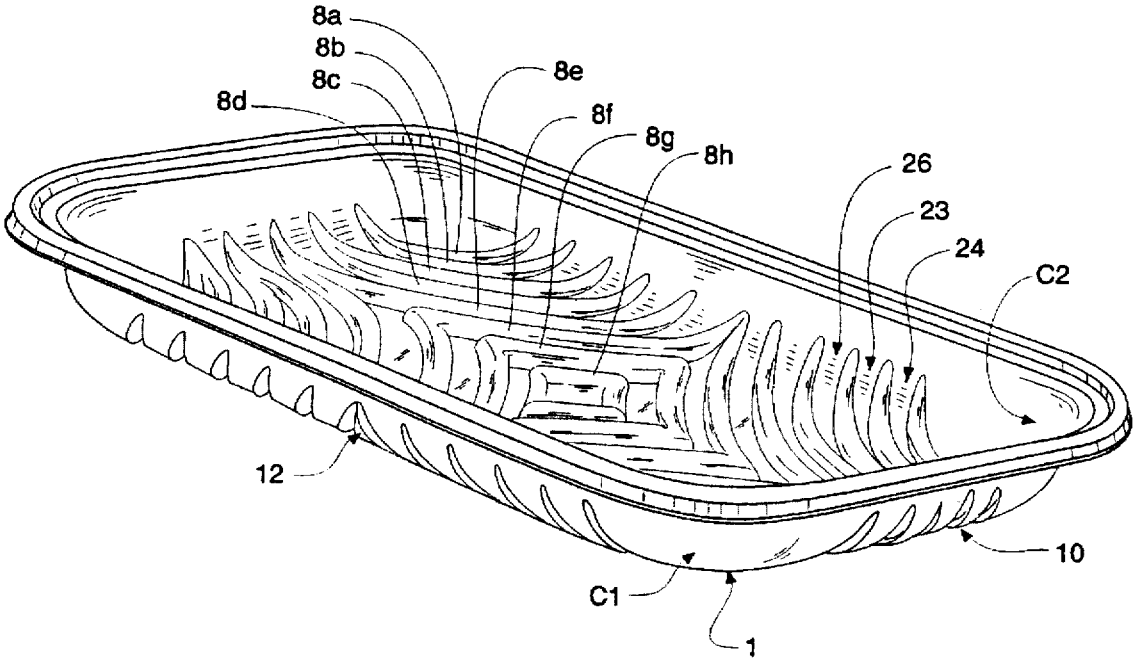
FIG. 2 is a perspective view of the first container portion.

With particular reference to FIG. 2 and FIG. 6, the first container portion 1 is provided with molded ribs referenced $8_a$ to $8_h$, from the outside corner ($C_1$) to the center. On the three other quadrants, same ribs are symmetrically provided.

In order to allow the tightness of the space 7, the second container portion 2 can be welded simultaneously on its periphery and on the top of each rib.

Ribs have a general elliptic shape, the shape varying however according to their location over the surface of the first container portion.

For instance, ribs $8_a$, $8_b$ are bound in 9 by one of their ends on one of the sides 10 of the first container portion 1, while the opposite ends $11_a$–$11_b$ are separated near the adjacent side 12.

Ribs $8_c$, $8_d$ are bound in 13 at one of their ends near the side 10, while the opposite ends $14_a$, $14_b$ are separated near the side 12.

On the contrary thereto, the rib $8_e$ joins the symmetrical rib $8_{e'}$ of the symmetrical quadrant (corner $C_2$) in a point 15 located near the side 10, while its other end 16 is near the side 12.

One of the ends of the rib $8_f$ joins in 17 the symmetrical rib $8_f$ of the quadrant $C_2$, while the other end joins in 18 the symmetrical rib $8_{f''}$ of the third quadrant $C_3$.

Ribs $8_g$, $8_{g'}$ join in 19 at one end and ribs $8_g$, $8_{g''}$ join in 20. Ribs $8_h$, $8_{h'}$ and $8_{h''}$ join in 21 and 22. The meeting points 17, 19, 21 are directed to the side 10, inside the surface of the first container portion 1. The meeting points 18, 20, 22 are directed to the edge 12, and are also inside the surface of the first container portion 1.

According to the aforementioned various aspects, ribs $8_a$–$8_h$ define, between each other and the first and second container portions 1, 2 closed chambers, separated to each other. The shape of these chambers is either elongated from the side 10 to the side 12, as chamber referenced 23 located between ribs $8_d$ and $8_e$, and chamber 24 located between ribs $8_b$ and $8_c$; or a shape opened to the side 12, as chamber 25, opened between ribs $8_c$ and $8_d$; or a V shape as the chamber 26 located between sides 12 and 27 and closed in 18 between ribs $8_e$, $8_f$, $8_{e'}$ and $8_{f'}$; or at least a square curvilinear chamber 29 defined by the four ribs $8_g$, $8_{g'}$, $8_{g''}$, $8_{g'''}$.

The same configurations appear symmetrically in the four quadrants corresponding to the four corners $C_1$, $C_2$, $C_3$, $C_4$.

The main feature of these configurations is that the chambers defined by the elliptical ribs between first and second container portions 1, 2 are:

closed, small sized, and curved.

As a result, the amount of liquid exuded by the fresh product and received in each chamber through the apertures 3 of the second container portion is really small, and completely isolated from the other chambers. Furthermore, if the tray is moved, said small amount of liquid can only move along curved and elongated paths, along which it is not possible to accumulate but, on the contrary thereto, the liquid is spread and divided in much smaller amounts. It is consequently not possible for the exuded liquid to accumulate in any area of the first container portion 1, even if the latter is swung strongly, as well as it is not possible that the liquid comes back in contact with the fresh product.

There is however provided an additionnal absorbing pad appearing in FIGS. 4, 4*a* and 5 still reducing the liquid amount going to the chambers via the apertures 3.

As it is shown in the enlarged view of FIG. 4*a*, said absorbing pad 30 is perforated to allow the passage of the bottom extending walls of the apertures 3.

In order to drain the exuded liquid to the apertures 3, the second container device 2 is provided with drains 31 starting the drainage, as represented in FIGS. 3, 3*a* and 6.

Said drains are triangular shaped, with an increasing depth, so that they open at the level of the bottom part of the apertures 3. The number and the position of the sloping drains is such that they collect all of the liquid exuded by the fresh product and that they drive it to the apertures 3, which are distributed over every chambers 23, 24, 25, 26, 29, etc. defined by the ribs. As shown in FIG. 6, drains 31 are moreover oriented parallel to the direction of the corresponding chambers, starting by capillarity the flow of the liquid towards this chamber.

This embodiment of the drains and apertures results in a draining towards the closed space 7 even if the tray is in a very sloped position, for instance on the shelf of a shop. The wall portions extending from the apertures being sawn-off cones, as it appears in FIG. 3*a*, the liquid cannot go back in contact with the fresh product, even if the container is turned upside down.

The division of the liquid into small isolated volumes is significant for several reasons:

- in each chamber, the small volume of liquid is separated from either the second container portion 2 or the absorbing pad by air constituting a sort of airholder for fresh air, improving the preservation;
- packages according to the present invention are often sloped when displayed in supermarkets. If the volumes of exuded liquid could be mixed together, they would go down towards a bottom area, where they could have a permanent contact with the first container portion or with the absorbing pad, preventing them from drying and contributing to the spreading of bacterial flora. The fresh product rests however on the second container portion and said pad is also almost in contact with said product via the foresaid apertures. The apertures allow the passage of the liquid in both directions, so that, in the prior trays, when the absorbing pad is saturated in lateral areas, liquid could at last touch the product. This is impossible with the tray of the invention.

the volumes of air contained in the chambers can react towards elements of the absorbing pad, for instance hydrocaptor compound inhibiting action of the bacterial flora generated by the product. The pad is located between two air reserves, and is not only in contact with the air reserve surrounding the product.

It should be noted that the packaging operation is sometimes made under modified atmostphere, and that the absorbing pad may also contain hydroreagents regenerating the initially injected atmosphere. It is then necessary to treat the atmosphere surrounding the product, as well as in the chambers of the first container portion.

That is why the division of the exuded liquid into small and immobilized volumes, by ribs defining the various chambers, is very important. On top of that, the ribs are also important in the mechanical resistance of the tray according to the invention.

To make the description easier to read, the advantages provided by the ribs in a mechanical aspect will be described when the tray is closed by a surrounding thin sheet of plastic material, but it is clear that these ribs are as efficient if the tray is closed by a peripheral welded non retractable thin sheet of polyethylene, PVC, PET or the like, liquidtight and gastight or not.

The thin sheet of polyethylene used to close the product on the second container portion is generally thermoretractable, i.e. the closing is made by passing the tray in a heated atmosphere causing the retraction of the sheet which get in close contact with the external shape of the tray and its content. The thin sheet is then tightened and exerts consequently stresses around the periphery of the tray.

Said stresses do not affect the product, but are applied to the tray, and directed to its center. If the tray is made by thermoforming a quite thin layer of polystyrene, it might be folded or twisted, even if, as it is known in the prior art, there are parallel ribs in one direction.

On the contrary thereto, the ribs according to the invention are in each point directed to be oriented in the direction of the stress exerted on that point. Thus, in the areas close to the both symmetrical axes, the ribs are oriented so that they are parallel to these axes, longitudinally near the side 10 (or opposite side), and transversally near the side 12 (or opposite side). In other words, the shape of the ribs is opposed to the buckling of the tray 1, in a longitudinal direction when it is submitted to stresses exerted on the small sides, and in a transversal direction if the stresses are exerted on the big sides. In each intermediary point, each rib is opposed to the twisting of the tray, resisting against the stress exerted on that point, tangentially to the rib.

The pattern of the ribs distributed into four quadrants in the first container portion 1 is the ideal physical model allowing opposition to any deformation of the tray when submitted to peripheral stresses. The said ribs, with their shapes and locations, have a double function, solving then the aforementioned double problem.

Ribs serve also in other capacities.

Thus, considering the structure described in the document PCT WO 86/07036, mentioned above as a prior art document, the rectilinear parallel ribs do not constitute small volumes, because they are quite spaced to each other, and on top of that, the second container portion do not rest on the ribs, so that a deformation is possible between two adjacent ribs. On the contrary thereto, the pattern defined by the ribs of the tray of the invention provides for such a rest, and ensure therewith the indeformability of the second container portion.

Otherwise, as especially seen from the FIG. 2, the ribs of the first container portion 1 stop at a distance of the top edge of said portion 1. This is made for making easier the piling up of the trays, each one resting on the top of the ribs of the tray located below, preventing them from being blocked together and making easier their parting.

The shape of the ribs according to the invention is not critical, although the above description has made reference to concav elliptic ribs, the latter could also have the same shapes, but convex, or even mathematically perfect ellipses. The only requirements the ribs must satisfy are the following:

They must extend from one side to the adjacent one, being approximately perpendicular to said sides, following a curve adapted to the sizes of said sides. This curve is consequently preferably approximately a quarter of an ellipse;

They must be enough close to define between themselves and the first and second container portions chambers enough small to cut off very small volumes of liquid exuded by the product, of about 1–1,5 $cm^3$.

The volume of liquid depends of course on the packaged product.

Thus, for instance, it can reach 1% of the weight in a slice of red meat, while it is about 5% for fresh fish, the liquid being either blood or salted water.

A fish, for instance of 100 g, will release approximately 5 g of salted water, which represents roughly 5 $cm^3$. A bigger fish, or part of fish, will exude a proportionally bigger quantity of liquid, but this amount will be divided into a greater number of small individual volumes, since the tray will also be bigger.

That is the reason why the principle of the tray according to the invention is based on the division of the entire volume into a great number of individual volumes, separated to each other, and proportionnally very smaller, in contrast with the bigger volumes of the trays as disclosed in the PCT N° 86/07036.

According to the invention, in order that the exuded liquid released by a packaged product such as meat, fish shop products or the like, could not pollute said packaged product, the total volume of said exuded liquid must be separated in small volumes of approximately 1,5 $cm^3$ or less.

As above described, the second container portion can be secured to the first container portion by any appropriate means, provided that the tightness is ensured: welding, snapping in or the like. The resulting assembly is preferably provided with an inward oriented edge 6, so that the handling of the tray is easier than if this edge was sharp and oriented outward. The inwardly folding back of the edge reduces moreover the risk for the thin transparent film sheet to be cut, and allows the use of thinner film. The angle of said folding back is preferably chosen about 45°.

In all of the above description, the geometrical pattern of the ribs has been brought out, because the orientation of said ribs with respect to the periphery of the first container portion is essential. Thus, it is clear that the more the length of said portion increases compared to the width, the more the great axis increases compared to the small axis of the respective ellipses.

In connection with the small volumes defined between the first and the second container portions, it is also clear that, according to the height of the ribs, said volumes will be bigger or smaller. This height must be taken into consideration for fulfilling the second aim of the ribs, i.e. the rigidification of the tray. In each case, it will be necessary to find a compromise between the size of the first container portion and the height of the ribs, and also especially with the width of said ribs which contributes also to the rigidity, taking account of the quantity of liquid expected regarding to the product.

The ribs have to be higher when the tray contains a fish like a young turbot of 30 cm×15 cm, instead of a steack of 20 cm×10 cm.

The present invention concerning essentially said ribs, any dimensional modifications made to these ribs will be in the frame of the said invention. This is the same for the shape of the section of the ribs, which can furthermore vary from one rib to another as well as for the number of ribs existing on the first container portion. Furthermore, a portion of the latter may contain ribs, while another portion may be raised, so that its height is the same as the height of the ribs. The raised portion can cover any part of the surface of the first container portion, the central portion as well as the peripheral surface.

According to another possible embodiment, the above-mentioned arcs of ellipses are formed by two rectilinear parts, linked by an obtuse angle, as schematically illustrated in FIG. 7, differing from FIG. 6 only by the rectilinear aspect of the segments 40, 40', 41, 41', 42, 42', . . . forming the ribs. The orientation and the embodiment of these ribs are equivalent to those of the arcs of ellipses according to the first claim, the linking angles 43, 44, 45 of said segments giving the segments 40, 41, 42 an orientation perpendicular to the side 10, while the orientation of the segments 40', 41', 42' is perpendicular to the side 12. The above remarks about the rigidity given by the elliptical ribs 8 are still true.

As well as for the thin transparent sheet, the first and the second container portions can be made by every appropriate technique, of every appropriate material such as polystyrene, polyethylene, PVC, PET or the like.

I claim:

1. Package for the packaging and the preservation of fresh food, which tends to exude fluids favouring a rapid growth of bacterial flora limiting the selling deadline, being of the type comprising a tray on which rests the fresh product and a thermoretractable thin sheet of film material overwrapping said product in said tray comprising:

a relatively rigid and impermeable first container portion, and a second container portion on which the fresh product rests, fitted in said first container portion, and including apertures allowing the passage of the fluids, said second container portion resting on corrugations or ribs of said first container portion, to define a predetermined number of closed chambers, wherein in order to allow an isostatic rigidification of said first container portion, and a controlled collecting of the fluids exuded by the product in said chambers, the ribs are distributed according to at least one network of approximately parallel ribs, each one extending at least along two directions so that said rib is in each of its points directed to resist the corresponding component of the peripheral stress caused by the film material overwrapping the package, one end of each rib being perpendicular to one side of said first container portion, while the other end of each rib is perpendicular to an adjacent side of said first container portion.

2. Package according to claim 1 wherein said ribs have a polygonal shape, including two segments forming an obtuse angle.

3. Package according to claim 1 wherein said ribs are curvilinear.

4. Package for the packaging and the preservation of fresh food which tends to exude fluids favouring a rapid growth of bacterial flora limiting the selling deadline, being of the type comprising a tray on which rests the fresh product and a thermoretractable thin sheet of film material overwrapping said product in said tray comprising:

a relatively rigid and impermeable first container portion, and a second container portion on which the fresh product rests, fitted in said first container portion, and including apertures allowing the passage of the fluids, said second container portion resting on corrugations or ribs of said first container portion, to define a predetermined number of closed chambers, wherein in order to allow an isostatic rigidification of said first container portion, and a controlled collecting of the fluids exuded by the product in said chambers, the ribs are distributed according to at least one network of approximately parallel ribs, each one extending at least along two directions so that said rib is in each of its points directed to resist the corresponding component of the peripheral stress caused by the film material overwrapping the package, one end of each rib being perpendicular to one side of said first container portion, while the other end of each rib is perpendicular to an adjacent side of said first container portion, wherein said ribs take the general shape of arcs of ellipses distributed into four groups located in the four rectangular quadrants of said first container portion defined by two axes of symmetry, each of the arc of ellipse being elongated, with one of its ends being located along or closely adjacent to one side and the other end being located along the adjacent side, so that said chambers are also elongated and curvilinear.

5. Package according to claim 4, wherein said chambers constitute a network which meshes and opens to at least one aperture, in order to canalize, cut off and keep the part of the fluid having passed the innermost second container portion via said apertures in many individual parts, preventing them from moving in the total space defined between said first and said second container portions, and from accumulating where they could contaminate the packaged product.

6. Package according to claim 5, wherein each rib extends from one side of the first container portion to an adjacent side thereof, the ends thereof being approximately perpendicular to said sides, and following a curve corresponding to the size ratio of said sides, said ribs being near enough to each other so that they define between themselves small volumes, the small size of which being adapted to cut off and stop small portions of the exudate, in the order of 1–1.5 $cm^3$.

7. Package according to claim 5, wherein each chamber comprises at least one aperture provided with a wall portion which extends towards said first container portion, and with at least one sloped drain helping to start the flowing of the fluid in said apertures by capillarity, the depth of the said drain increasing to reach, at the location of the aperture, the length of said wall portion.

8. Package according to claim 5, wherein, between said second container portion and the uppermost surface of said ribs, is an intermediate pad using at least partially the area located between said first and said second container portions, said pad adapted to absorb fluids or to preserve better the fresh product by allowing a gaseous exchange with said area.

9. Package according to claim 8, wherein sawn-off cone apertures are provided in said intermediate pad, in holes perforated therein.

10. Package according to claim 8, wherein said pad contains hydroretaining products provided for keeping the exudate and antibacterial and/or hydroreagent products for regenerating the atmosphere and contributing to the preservation of the fresh products.

11. Package according to claim 1, wherein said first container portion being divided into four quadrants by two symmetrical axes, and said ribs are distributed into four corresponding groups, the concavity thereof being oriented towards the respective corners.

12. Package according to claim 1, wherein said first container portion being divided into four quadrants by two symmetrical axes and said ribs are distributed into four corresponding groups, the concavity thereof being oriented towards the center of the package.

13. Package according to claim 1, wherein the ends of said ribs are located a predetermined distance from the upper edge of said container portion to facilitate the piling up of the trays and the parting of said trays.

14. Package according to claim 1, wherein said first and second container portions are fixed together by means to provide the tightness of the assembly, the edge of the assembly being oriented inwardly at about 45°.

15. Package according to claim 1, wherein said first container portion is formed of polystyrene, polyethylene, PVC, or PET.

16. Package according to forms of claim 1 wherein a thin transparent sheet is formed of polyethylene, retractable polyethylene, PVC, or PET capable of forming a barrier.

17. Package according to claim 16, wherein said thin transparent sheet is applied to the tray by thermoretraction or welding.

18. Package according to claim 1, wherein one portion only of the bottom comprises ribs, and another constitutes a continuous raised zone of the same height as the ribs, said zone representing a predetermined fraction of the surface of the bottom.

* * * * *